US005657663A

United States Patent [19]

Miyahara et al.

[11] Patent Number: 5,657,663

[45] Date of Patent: Aug. 19, 1997

[54] MULTI-STAGE FORGING APPARATUS

[75] Inventors: Hiroshi Miyahara, Kuki; Hiroshi Ikeda, Hirakata, both of Japan

[73] Assignee: Kabushiki Kaisha Sakamura Kikai Seisakusho, Osaka, Japan

[21] Appl. No.: 560,967

[22] Filed: Nov. 20, 1995

[30] Foreign Application Priority Data

May 16, 1995 [JP] Japan ..... 7-142727

[51] Int. Cl.[6] ..... B21D 22/00; B21J 13/10

[52] U.S. Cl. ..... 72/356; 72/361; 72/420

[58] Field of Search ..... 72/356, 361, 354.6, 72/420, 355.4, 355.1, 334

[56] References Cited

U.S. PATENT DOCUMENTS

| | | | |
|---|---|---|---|
| 3,587,157 | 6/1971 | Mundt | 72/356 |
| 3,889,512 | 6/1975 | Delio | 72/356 |
| 4,227,394 | 10/1980 | Heimel | 72/361 |
| 4,378,688 | 4/1983 | Spanke et al. | 72/420 |
| 4,463,587 | 8/1984 | Werner | 72/361 |
| 4,932,251 | 6/1990 | Okada et al. | 72/356 |

FOREIGN PATENT DOCUMENTS

| | | |
|---|---|---|
| U15728/88 | 10/1988 | Japan . |
| P228636/89 | 9/1989 | Japan . |
| P60842/91 | 3/1991 | Japan . |
| U34837/94 | 5/1994 | Japan . |

*Primary Examiner*—David Jones
*Assistant Examiner*—Rodney A. Butler
*Attorney, Agent, or Firm*—Barnes & Thornburg

[57] ABSTRACT

The invention provides a multi-stage forging apparatus for forging a work in transportation through a plurality of forging stations each provided with a die and a punch so that the work is progressively refined, in which the position of the work is changed during the forging procedure. A work, for example, consisting of a shank and a ring-shaped head can be produced. The forging apparatus includes a position change station having a rotation unit instead of a die. The rotation unit contains a pair of rotation bodies with gears. The gears are engaged with racks rotated synchronously with the movement of a crank shaft. When an intermediate work consisting of a shank and a ball-like head is driven into a space between the rotation bodies, the rotation bodies are rotated so as to shift the intermediate work to a vertical position where the shank extends perpendicularly to the driving direction of a punch, and the vertically positioned intermediate work is pushed out of the rotation unit by a knockout pin.

9 Claims, 18 Drawing Sheets

MULTI-STAGE FORGING APPARATUS

BACKGROUND OF THE INVENTION

1. Field of the Invention

The present invention relates to a multi-stage forging apparatus for forging a work in transportation through a plurality of forging stations each provided with a die and a punch so that the work is progressively refined, and more particularly, it relates to a multi-stage forging apparatus in which the position of the work is changed during the forging procedure.

2. Description of Related Art

A typical forging apparatus for making a bolt, a nut and other component parts has a structure as shown in FIG. 20. The forging apparatus of FIG. 20 comprises a base 2 for supporting a die block 3 at a predetermined position. The die block 3 is provided with a plurality of dies 81 to 84. A ram (not shown) disposed movably toward and away from the dies 81 to 84 is provided with the same number of punches as that of the dies. Each combination of the dies and the punches constitutes a forging station. A work in the shape of a rod with a desired length is driven into the die by the punch in each station. The forged work in each station is caught by corresponding one of chucks 90 to 94 and transported to the subsequent station. This type of forging apparatus thus enables mass-production of component parts.

When a work X consisting of a shank (a) and a ring-shaped head (b) as shown in FIG. 21 is to be produced, a rod-shaped work is first forged into an intermediate work X3 having a shaft (a) and a ball-like head (d) as shown in FIG. 22. The ball-like head (d) is then flattened and pierced into a ring. It is, however, regarded to be difficult to consistently produce the work X having the ring-shaped head (b) by using the aforementioned forging apparatus for the following reason: The intermediate work is driven by the punch into the die in the direction shown with an arrow in FIG. 22 (i.e., in the horizontal direction), which corresponds to the axial direction of the work. Therefore, after forging the ball-like head (d), in order to flatten the ball-like head (d) with the punch and the die or pierce the head into a ring, it is necessary to change the position of the intermediate work X3 so that the shank (a) of the intermediate work X3 is perpendicular to the driving direction of the punch with the ball-like head (d) upward. The conventional forging apparatus cannot change the position of a work during the forging procedure, and hence, there is no choice but to use a press to flatten or pierce the ball-like head (d). This is a burden for mass-production of such component parts.

SUMMARY OF THE INVENTION

The present invention was devised to overcome the aforementioned problems, and one objective is providing a multi-stage forging apparatus for forging a work in transportation through a plurality of forging stations so that the work is progressively refined, in which the position of the work can be changed during the forging procedure. As a result, it is possible to forge an intermediate work having a shank and a head, and is also possible to continuously forge the head of the intermediate work after shifting the intermediate work from a horizontal position to a vertical position.

Another objective of the invention is providing a multi-stage forging apparatus in which an intermediate work having been shifted to a vertical position and pushed out of a die can be caught without fail and can be transported to a subsequent forging station without changing the vertical position of the intermediate work. Still another objective of the invention is providing a multi-stage forging apparatus having a structure for changing the position of an intermediate work to a vertical position in which the head of the intermediate work is retained at the same height before and after changing the position thereof, while the entire structure of the forging apparatus is suppressed from becoming complicated.

Still another objective of the invention is providing a multi-stage forging apparatus in which, during the forging procedure, an intermediate work having a shank and a head can be shifted from a horizontal position to a vertical position, the head of the shifted intermediate work can be forged into a desired shape, the resultant intermediate work can be shifted again from the vertical position to the horizontal position, and a thread groove can be formed on the peripheral surface of the shank of the horizontally positioned intermediate work.

The multi-stage forging apparatus of the invention forges a work in stepwise transportation through plural forging stations each provided with a die and a punch, so that an intermediate work having a shank and a head at one end of the shank is formed and that the head of the intermediate work is forged in a direction perpendicular to a direction in which the shank extends. The forging apparatus comprises a position change station among the plural forging stations. The position change station includes thrusting means disposed in front of the die of the position change station for thrusting the intermediate work in the same direction as a driving direction of the punch with the shank closer to the die; a pair of rotation bodies disposed beside the die of the position change station for sandwiching and holding the intermediate work having been thrust by the thrusting means; driving means for rotating the rotation bodies by 90 degrees after the intermediate work is held by the rotation bodies, so that the intermediate work is shifted to a position where the shank extends perpendicularly to the driving direction of the punch; and pushing means for pushing the intermediate work out of a space between the rotation bodies, after shifting the intermediate work, so that the intermediate work is vertically positioned in front of the die.

Accordingly, when, for example, a work consisting of a shank and a ring-shaped head is to be produced, an intermediate work consisting of a shank and a head is first formed in the forging stations previous to the position change station. Then in the position change station, the intermediate work is thrust by the thrusting means toward the die with the shank extending parallel to the driving direction of the punch. The intermediate work is held by the rotation bodies, which are then rotated by 90 degrees by the driving means. Thus, the intermediate work is vertically positioned with the shank extending perpendicularly to the driving direction of the punch. The vertically positioned intermediate work is pushed out of the die by the pushing means. In this manner, the vertically positioned intermediate work is transported to the subsequent station, where the head is flattened and pierced. Thus, the work consisting of the shank and the ring-shaped head can be consistently produced.

In one aspect, the position change station further includes grasping means disposed in front of the die and having a receiving face for receiving the intermediate work having been pushed out of the space between the rotation bodies for grasping the intermediate work between the receiving face thereof and a pushing face of the pushing means without changing the position of the intermediate work. The grasping means can reciprocate between a position in front of the die and a stand-by position in front and on one side of the die.

Accordingly, the intermediate work pushed out of the die of the position change station is grasped between the receiving face of the grasping means in front of the die and the pushing face of the pushing means while keeping its vertical position. The vertically grasped intermediate work is caught by a transporting chuck to be transported to the subsequent forging station without fail.

In another aspect, the head of the intermediate work held between the rotation bodies is located at the same height against a rotation center of the rotation bodies as the head of the intermediate work whose position has been changed by rotating the rotation bodies by 90 degrees.

Accordingly, the head of the intermediate work is located at the same height against the rotation center of the rotation bodies no matter whether the intermediate work is in the horizontal position or in the vertical position attained by rotating the rotation bodies by 90 degrees. Therefore, it is possible to locate the center of the head of the vertically positioned intermediate work having been pushed out of the die at the same height as the centers of the punches of the previous forging stations. As a result, when the head of the intermediate work is flattened and/or pierced in the subsequent forging stations, the centers of the punches and the dies in the forging stations posterior to the position change station can be set at the same height as the centers of the punches and the dies in the forging stations prior to the position change station. Thus, the structure of the forging apparatus is prevented from becoming complicated although the position change station is included.

Alternatively, the multi-stage forging apparatus of the invention forges a work in stepwise transportation through plural forging stations each provided with a die and a punch, so that an intermediate work having a shank and a head at one end of the shank is formed and that the head of the intermediate work is forged in a direction perpendicular to a direction in which the shank extends. The forging apparatus comprises a first position change station, among the plural forging stations, for shifting the intermediate work formed in the previous forging stations from a horizontal position to a vertical position and pushing the vertically positioned intermediate work out of the die of the first position change station; a final forging station disposed subsequently to the first position change station for forging the head of the intermediate work in the direction perpendicular to the direction in which the shank extends, so as to obtain a final work; a second position change station disposed subsequently to the final forging station for shifting the final work from the vertical position to the horizontal position and pushing the horizontally positioned final work out of the die of the second position change station; and a rolling station disposed subsequently to the second position change station and including a thread rolling die for forming a thread groove on a peripheral surface of the shank of the horizontally positioned final work.

In one aspect, the first position change station includes thrusting means disposed in front of the die of the first position change station for thrusting the intermediate work in the horizontal position parallel to a driving direction of the punch toward the die of the first position change station; a pair of rotation bodies disposed beside the die of the first position change station for sandwiching and holding the intermediate work having been thrust by the thrusting means; driving means for rotating the rotation bodies by 90 degrees, so that the intermediate work is shifted to the vertical position where the shank extends in a direction perpendicular to the driving direction of the punch; and pushing means for pushing the intermediate work out of a space between the rotation bodies so that the intermediate work is vertically positioned in front of the die. The second position change station includes thrusting means disposed in front of the die of the second position change station for thrusting the final work formed in the final forging station while keeping its vertical position; a pair of rotation bodies disposed beside the die of the second position change station for sandwiching and holding the final work having been thrust by the thrusting means; driving means for rotating the rotation bodies by 90 degrees, so that the final work is shifted in the horizontal position where the shank extends parallel to the driving direction of the punch; and pushing means for pushing the final work out of a space between the rotation bodies so that the final work is horizontally positioned in front of the die.

Accordingly, when a work such as an eye bolt consisting of a shank with a thread groove and a ring-shaped head is to be produced, an intermediate work having a shank and a head is formed in the forging stations prior to the first position change station. The intermediate work is then shifted from the horizontal position to the vertical position by using the thrusting means, the rotation bodies, the driving means and the pushing means of the first position change station. The vertically positioned intermediate work is transported to the subsequent stations, wherein the head is flattened and pierced to obtain the final work. After this, the final work having the shank and the ring-shaped head is shifted from the vertical position to the horizontal position in the second position change station by using the thrusting means, the rotation bodies, the driving means and the pushing means. The horizontally positioned final work is transported to the subsequent rolling station, where the thread groove is formed by the rotary type thread rolling die. In this manner, the work in the shape of an eye bolt consisting of a shank with a thread groove and a ring-shaped head can be consistently produced with one forging apparatus alone. This enables mass-production of the work in such a shape.

The above and further objects and features of the invention will more fully be apparent from the following detailed description with accompanying drawings.

DETAILED DESCRIPTION OF THE INVENTION

The present invention will now be described by way of examples referring to the accompanying drawings.

Figure 1:
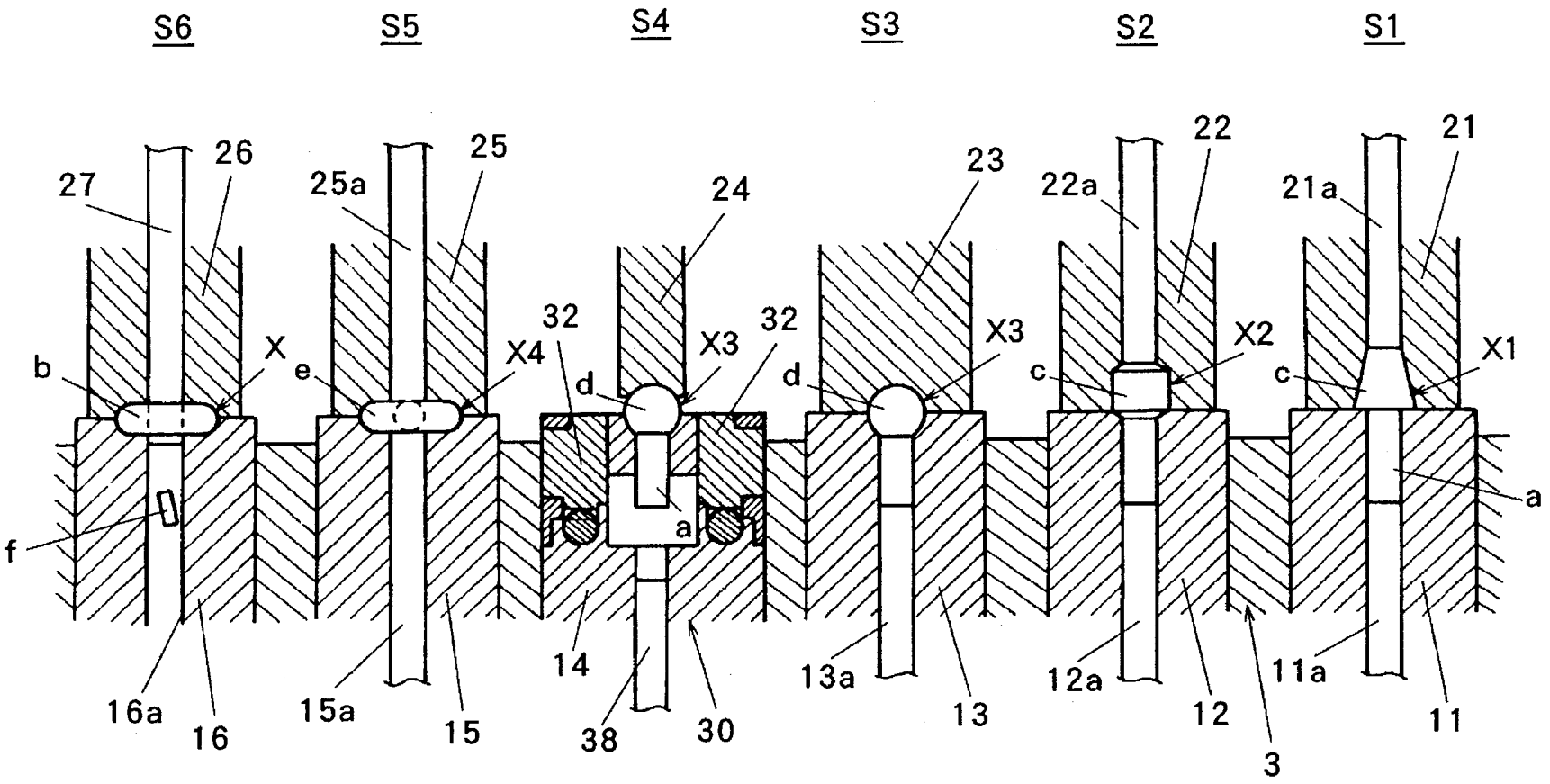
FIG. 1 is a sectional view of a main part of a forging apparatus according to an embodiment of the invention.
Figure 2:
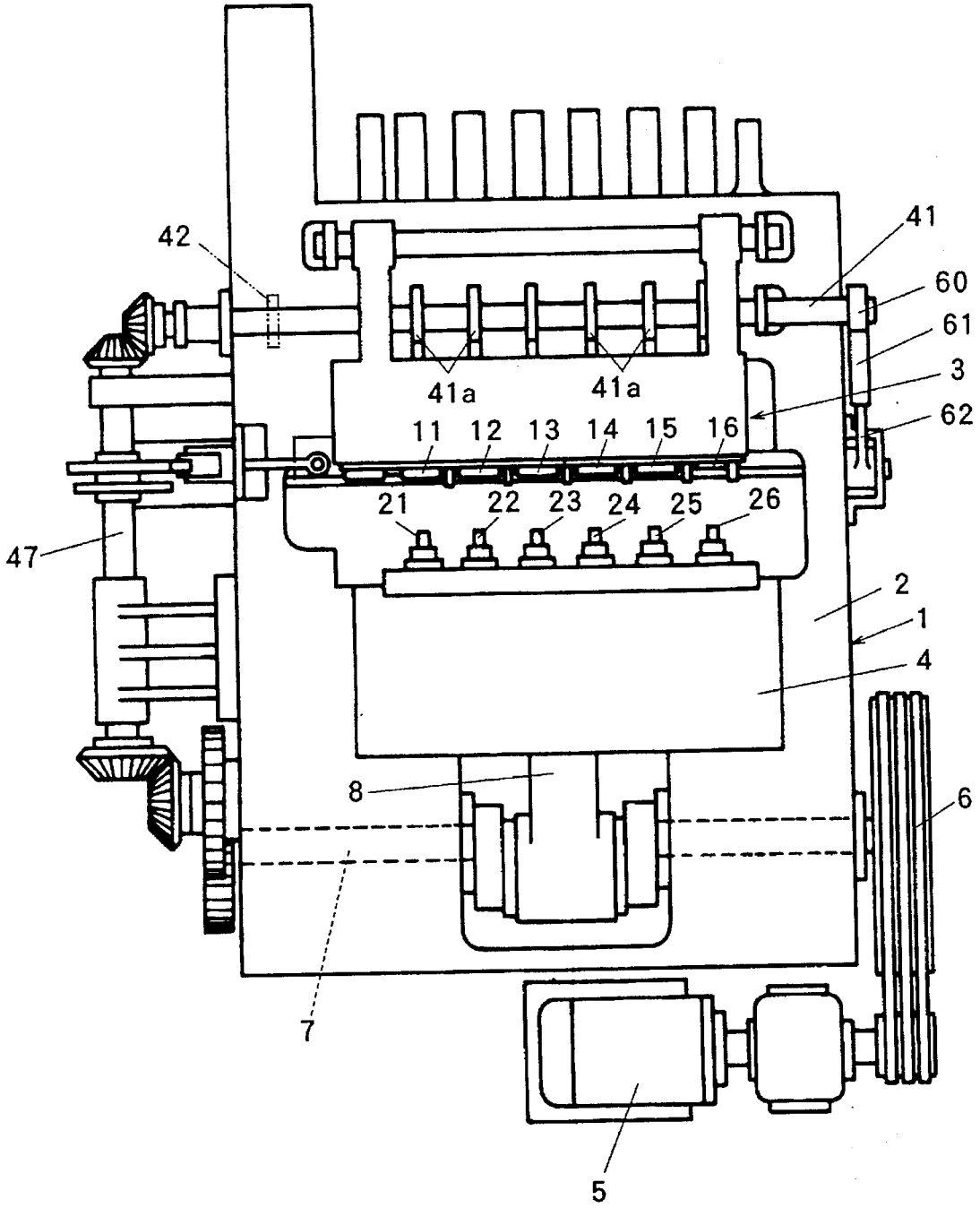
FIG. 2 is a schematic sectional view of the forging apparatus of FIG. 1.
Figure 3:
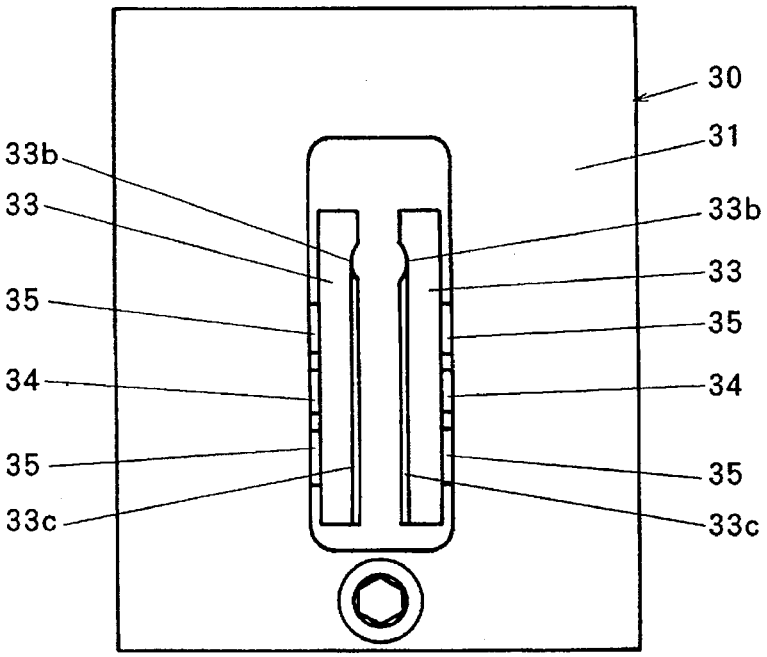
FIG. 3 is an enlarged front view of a station for changing the position of a work in the forging apparatus of FIG. 1.
Figure 11:
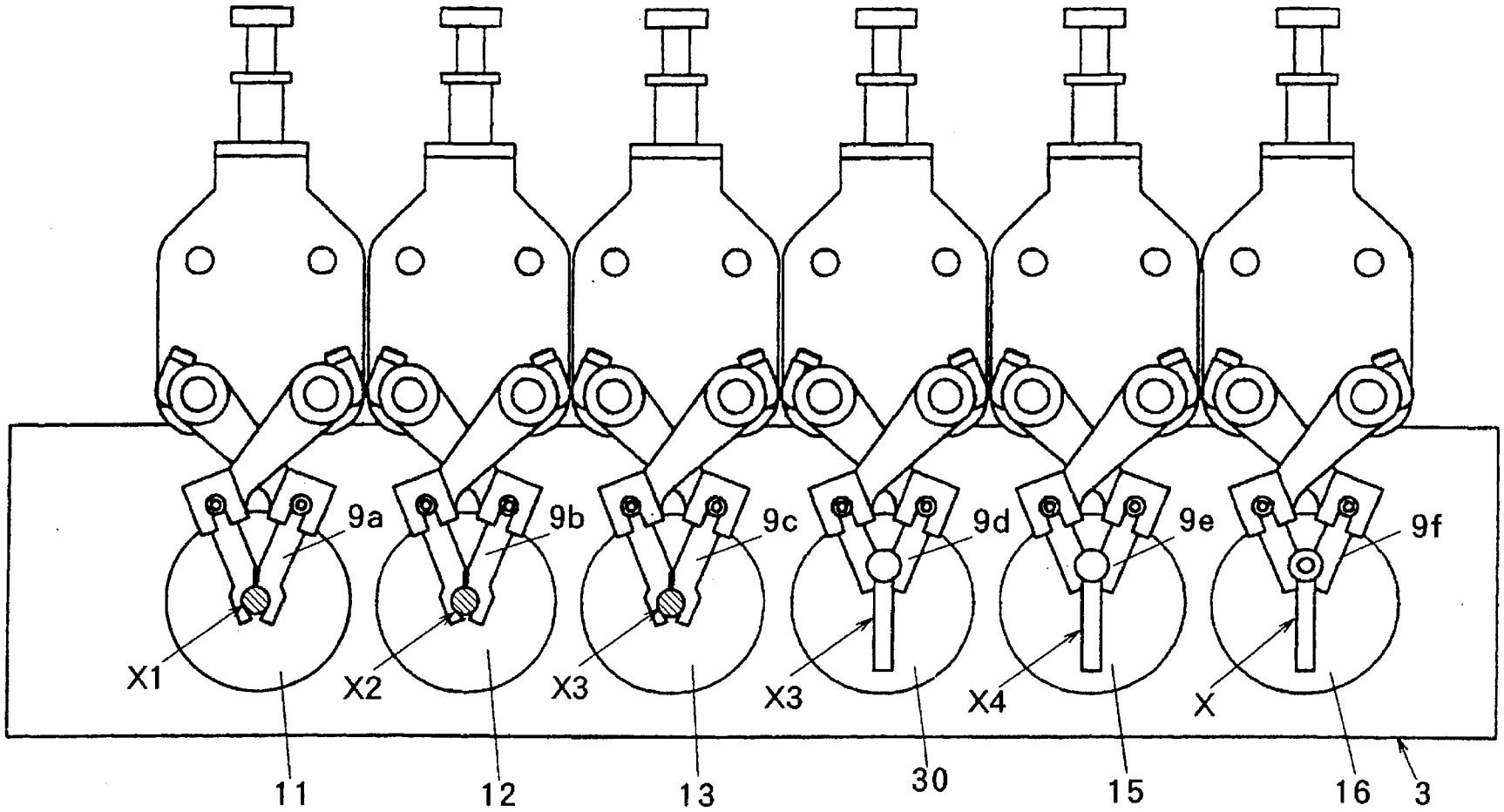
FIG. 11 is a schematic front view of chucks for transporting a work in the forging apparatus of FIG. 1.
Figure 21:
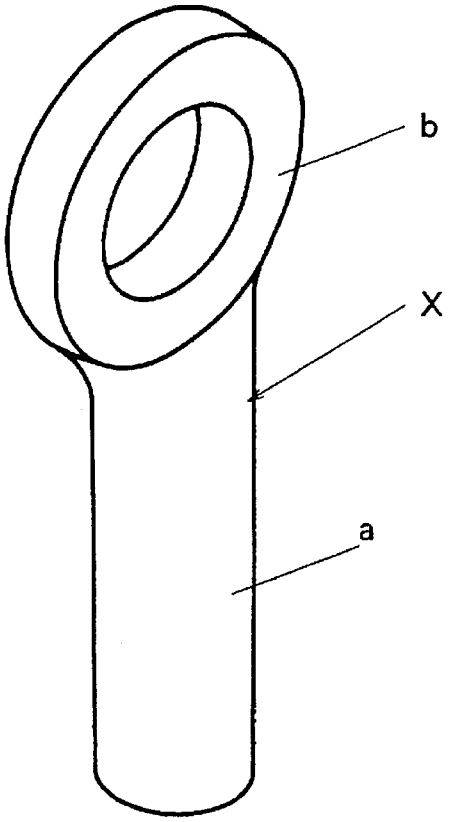
FIG. 21 is a perspective view of an exemplified work to be forged.

FIGS. 1 and 2 are schematic sectional views of a multi-stage forging apparatus for producing a work X having a shank (a) and a ring-shaped head (b) as shown in FIG. 21. The forging apparatus 1 comprises a base 2 for supporting a die block 3 at a predetermined position, and the die block 3 is provided with dies 11 to 16 at predetermined intervals as is shown in FIG. 1. The base 2 is further provided with a ram 4 so as to oppose and move toward and away from the die block 3. On the ram 4 are disposed punches 21 to 26 respectively corresponding to the dies 11 to 16. Respective combinations of the dies 11 to 16 and the punches 21 to 26 constitute forging stations S1 to S6. A work is successively driven in the respective forging stations S1 to S6 by moving the ram 4 forward (i.e., toward the die block 3). The other face of the ram 4 is connected to a crank shaft 7 via a connecting member 8, the crank shaft 7 being integrally disposed on a fly wheel 6 rotated by a driving motor 5 for the forging apparatus 1. The driving force applied by the driving motor 5 is transferred through the connecting member 8 to the ram 4 so as to move the ram 4 toward or away from the die block 3. A work is transported from one station to another among the forging stations S1 to S6 by chucks 9*a* to 9*f*, which are schematically shown in FIG. 11.

Figure 22:
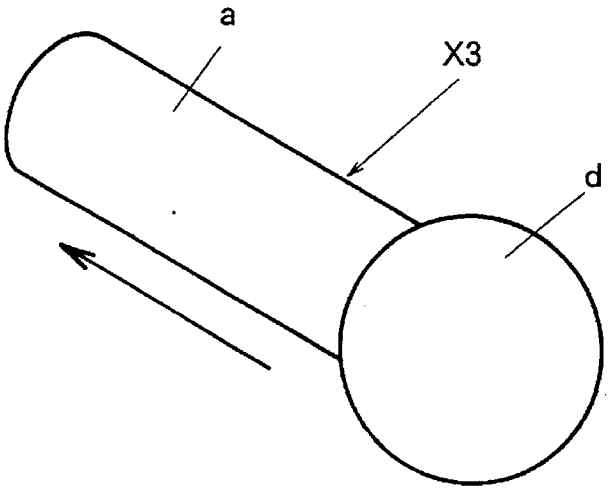
FIG. 22 is a perspective view of an intermediate work formed during the forging procedure for the work of FIG. 21.

A rod-like work with a desired length is driven by the punch 21 into the die 11 in the first forging station S1 as shown in FIG. 1, so as to be formed into an intermediate work X1 having a shank (a) and a head portion (c). The head portion (c) is driven by the punch 22 into the die 12 in the second forging station S2, so as to form another intermediate work X2 having the head portion (c) whose shape is further adjusted. The forging procedure performed by the first and second forging stations S1 and S2 are auxiliary forging operation to form an intermediate work X3 having a shank (a) and a ball-like head (d) as shown in FIG. 22 from a rod-like work. The head portion (c) of the intermediate work X2 is driven by the punch 23 into the die 13 in the third forging station S3, so as to finally form the intermediate work X3 having the ball-like head (d).

The fourth forging station S4 makes no contribution to the forging procedure for the intermediate work X3 but changes the position of the intermediate work X3 by thrusting the intermediate work X3 by the punch 24. In the fourth station S4, the intermediate work X3 is shifted from a position where the shank (a) extends parallel to the driving direction of the punch 24 (hereinafter referred to as the horizontal position) to a position where the shank (a) extends perpendicularly to the driving direction of the punch 24 with the ball-like head (d) upward (hereinafter referred to as the vertical position). Therefore, the fourth forging station S4 is designated as a position change station and is provided with a rotation unit 30 removably disposed on the die block 3 as a die 14 for changing the position of a work.

Figure 4:
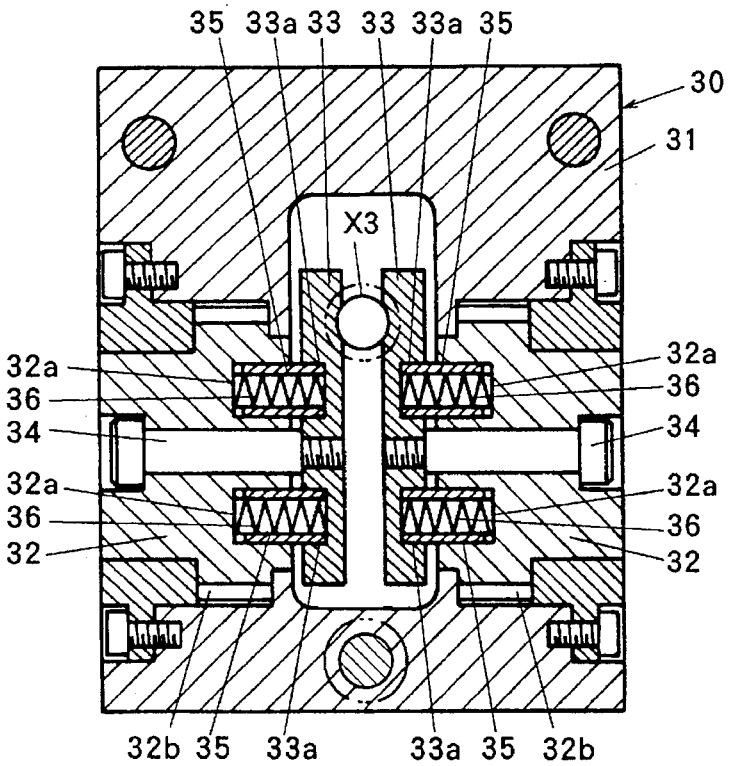
FIG. 4 is a longitudinal sectional front view of the station of FIG. 3.

The rotation unit 30 comprises, as is shown in FIGS. 3 to 8, a unit case 31 containing a pair of rotation bodies 32 rotatable around a horizontal axis which is vertical to the driving direction of the punch 24. Holding plates 33 are supported so as to face the rotation bodies 32. The intermediate work X3 having the ball-like head (d) is thrusted by the punch 24 into a space between the holding plates 33 while keeping its horizontal position. The holding plates 33 are provided movably along the axis of the rotation bodies 32 by a predetermined distance with bolts 34 as is shown in FIG. 4. Above and below the bolts 34 are formed recesses 32*a* and 33*a*, respectively, in which sleeves 35 and springs 36 penetrated by the sleeves 35 are respectively contained. The springs 36 apply a force to the holding plates 33 so as to bring them close to each other. When the intermediate work X3 is thrusted by the punch 24, the intermediate work X3 is held between the holding plates 33 by the force applied by the springs 36.

On the peripheral faces of the rotation bodies 32 are provided gears 32*b*, which are engaged with racks 37. Specifically, the unit case 31 is provided with a pair of racks 37 which are vertically movable as is shown in FIGS. 6 and 7, and the racks 37 are connected to driving means 40 for vertically moving the racks 37. Through the vertical movement of the racks 37 by the driving means 40, the holding plates 33 are reciprocatorily rotated by 90 degrees as the rotation bodies 32 are rotated. Owing to the 90-degree rotation of the holding plates 33, the intermediate work X3 having been driven into the space between the holding plates 33 is shifted from the horizontal position shown with a solid line in FIG. 5 to the vertical position shown with a two-dot chain line in FIG. 5.

Figure 9:
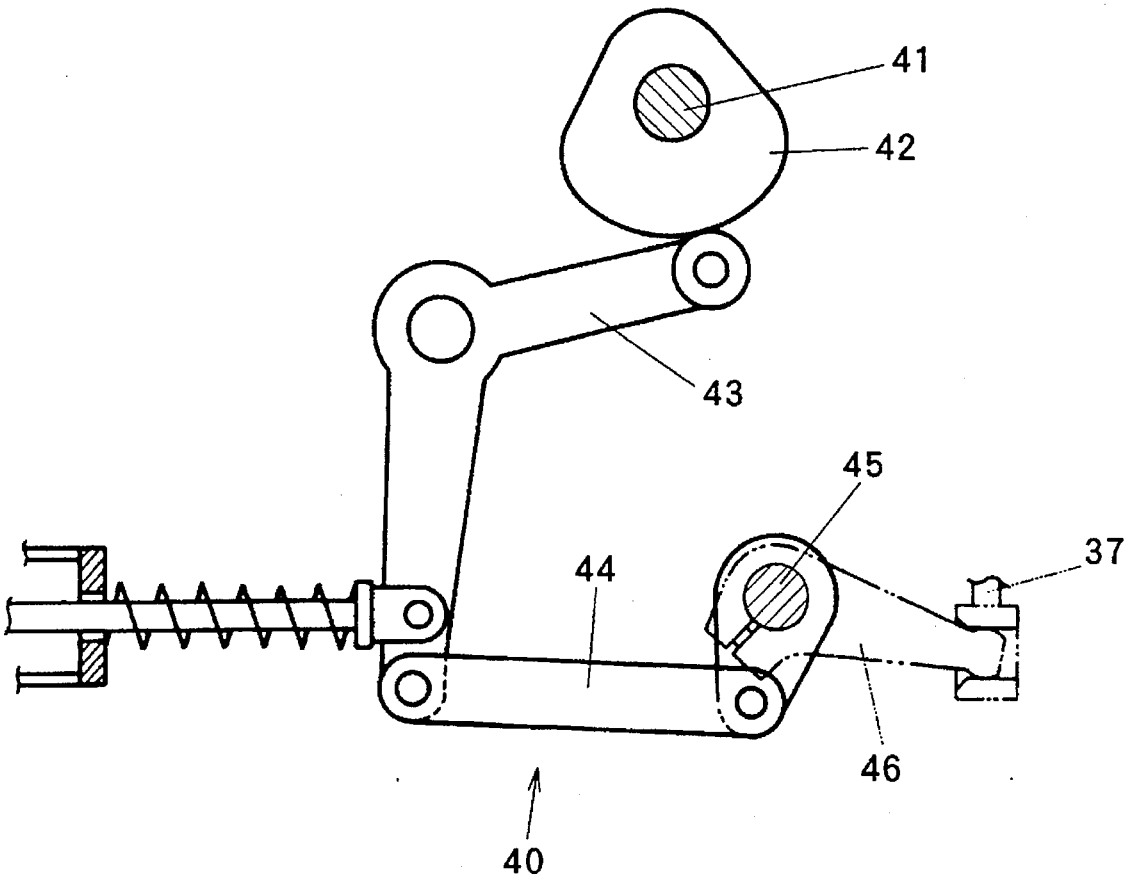
FIG. 9 is an explanatory diagram of driving means for rotation bodies of the station of FIG. 3.

The driving means 40 is constructed as is shown in FIGS. 7 and 9 as follows: A driving shaft 41 having cams 41*a* for opening and closing the chucks 9*a* to 9*f* is disposed above the base 2. The driving shaft 41 is provided with a rack driving cam 42 at its one end, which is interlocked with a rotation axis 45 via a bell crank 43 and a connecting arm 44. On the rotation axis 45 is fixed a lever 46 for elevating each rack 37. The driving shaft 41 is interlocked, via transmission means such as a bevel gear, with a transmission shaft 47 which is interlocked with the crank shaft 7 for moving the ram 4 forward and backward, as is shown in FIG. 2. Thus, the driving shaft 41 is rotated simultaneously with the crank shaft 7. As a result, the racks 37 are elevated synchronously with the backward or forward movement of the ram 4, namely, the rotation bodies 32 are rotated simultaneously with the backward or forward movement of the ram 4. In this manner, the rotation bodies 32 are rotated at a desired timing after the punch 24 drives the intermediate work X3.

Figure 5:
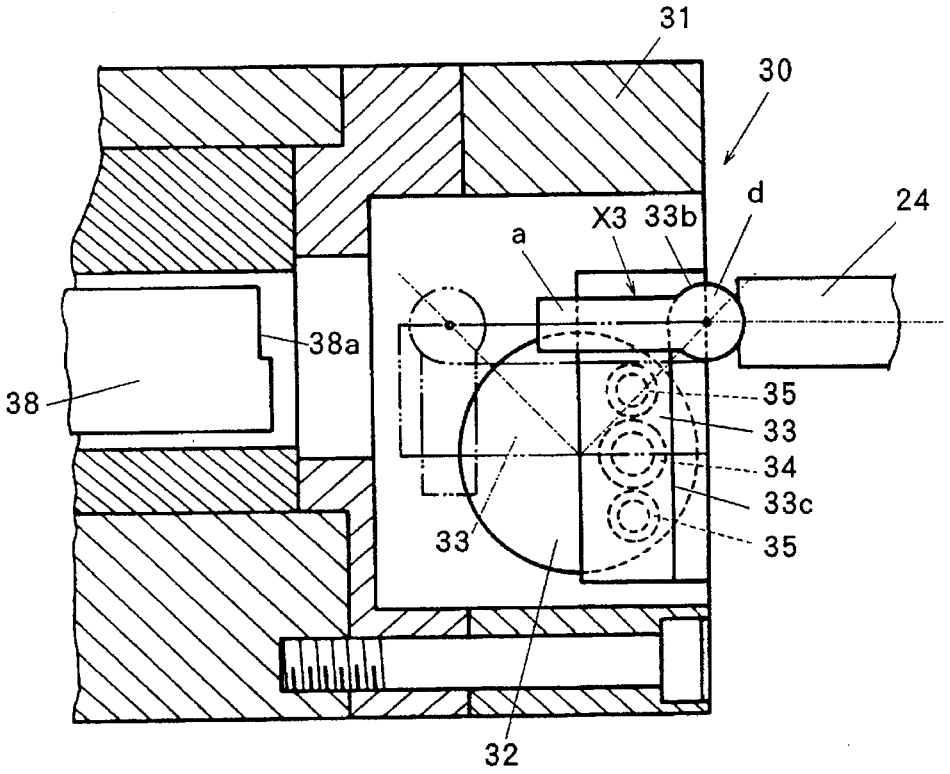
FIG. 5 is a longitudinal sectional side view of the station of FIG. 3.
Figure 6:
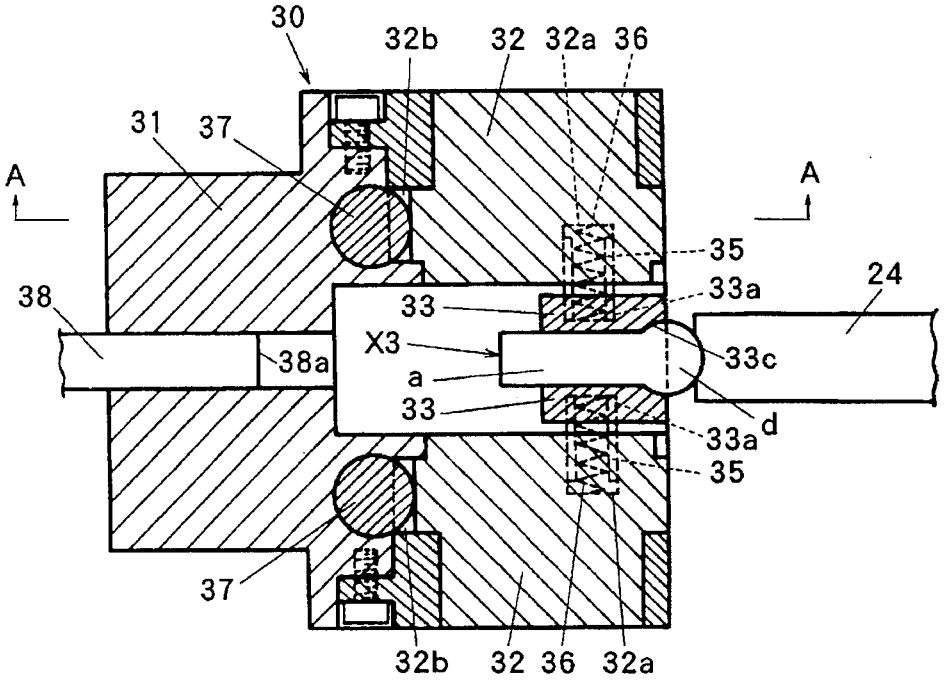
FIG. 6 is a horizontal sectional view of the station of FIG. 3.
Figure 7:
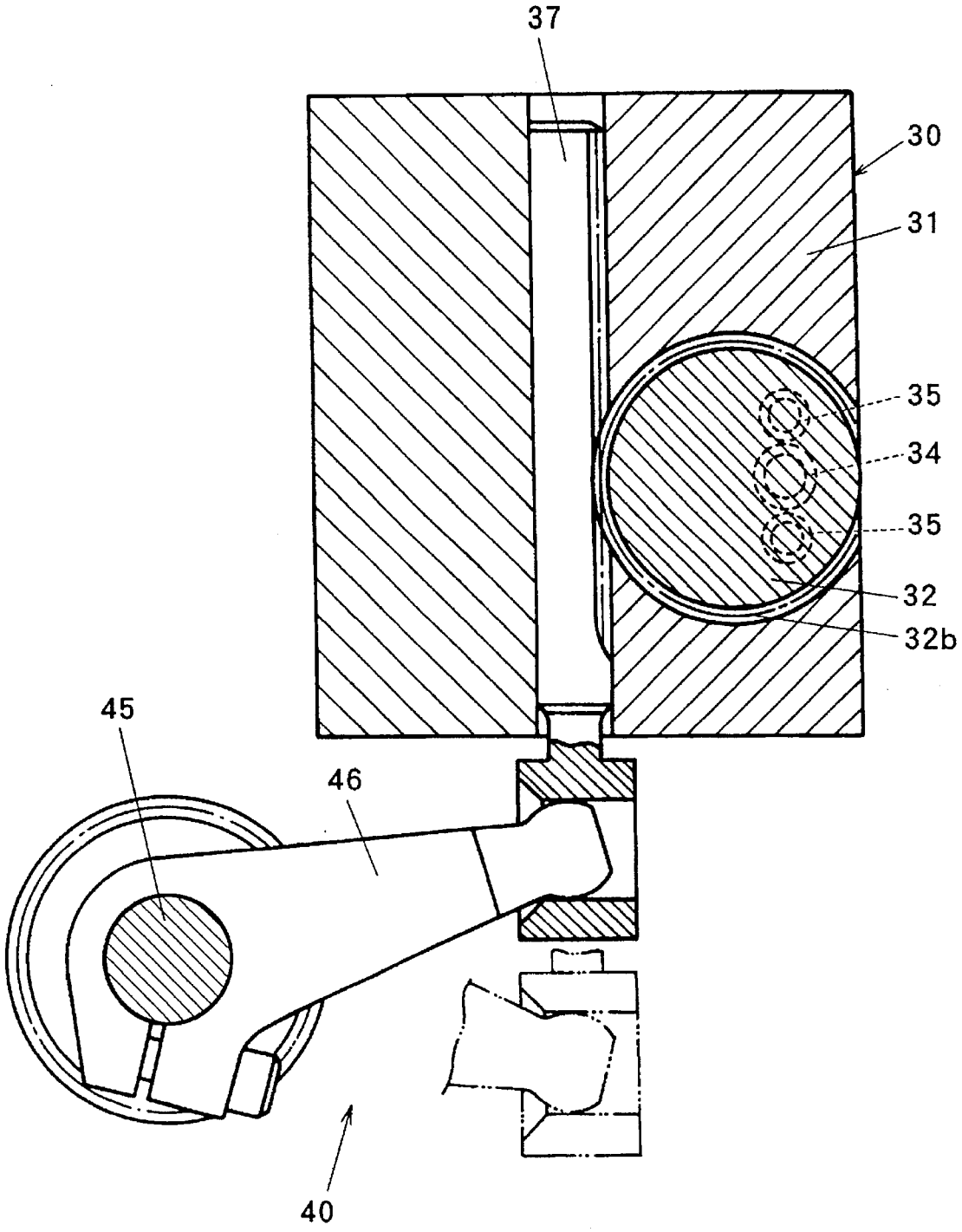
FIG. 7 is a sectional view taken on line A—A of FIG. 6.

In addition, as is shown in FIGS. 3 to 6, on the opposing faces of the holding plates 33 are formed holding parts 33*b* for receiving and holding a part of the ball-like head (d) of the intermediate work X3 which has been thrusted by the punch 24 and guide grooves 33*c* communicated with the holding parts 33*b* for guiding the ball-like head (d) of the intermediate work X3 when the intermediate work X3 is pushed from the space between the holding plates 33 out of the rotation unit 30. The holding parts 33*b* are formed such positions, as is shown in FIG. 5, that the ball-like head (d) of the intermediate work X3 held between the holding plates 33 is positioned at the same height against the rotation center of the rotation bodies 32 as the ball-like head (d) of the intermediate work X3 having been rotated by 90 degrees owing to the 90-degree rotation of the rotation bodies 32. In other words, the holding parts 33*b* are formed so that the center of the ball-like head (d) is positioned on an extended line at 45 degrees against a horizontal line extending from the rotation center of the rotation bodies 32 toward the ram 4, as shown with a dashed line in FIG. 5. Therefore, when the intermediate work X3 having the ball-like head (d) formed in the third forging station S3 is driven into the space between the holding plates 33 in the position change station S4, the intermediate work X3 is horizontally held between the holding plates 33 as shown with a solid line in FIG. 6. Then, the rotation bodies 32 are rotated by a driving force transferred from the driving means 40 via the racks 37, thereby shifting the intermediate work X3 into the vertical position as is shown with the two-dot chain line in FIG. 5.

Figure 8:
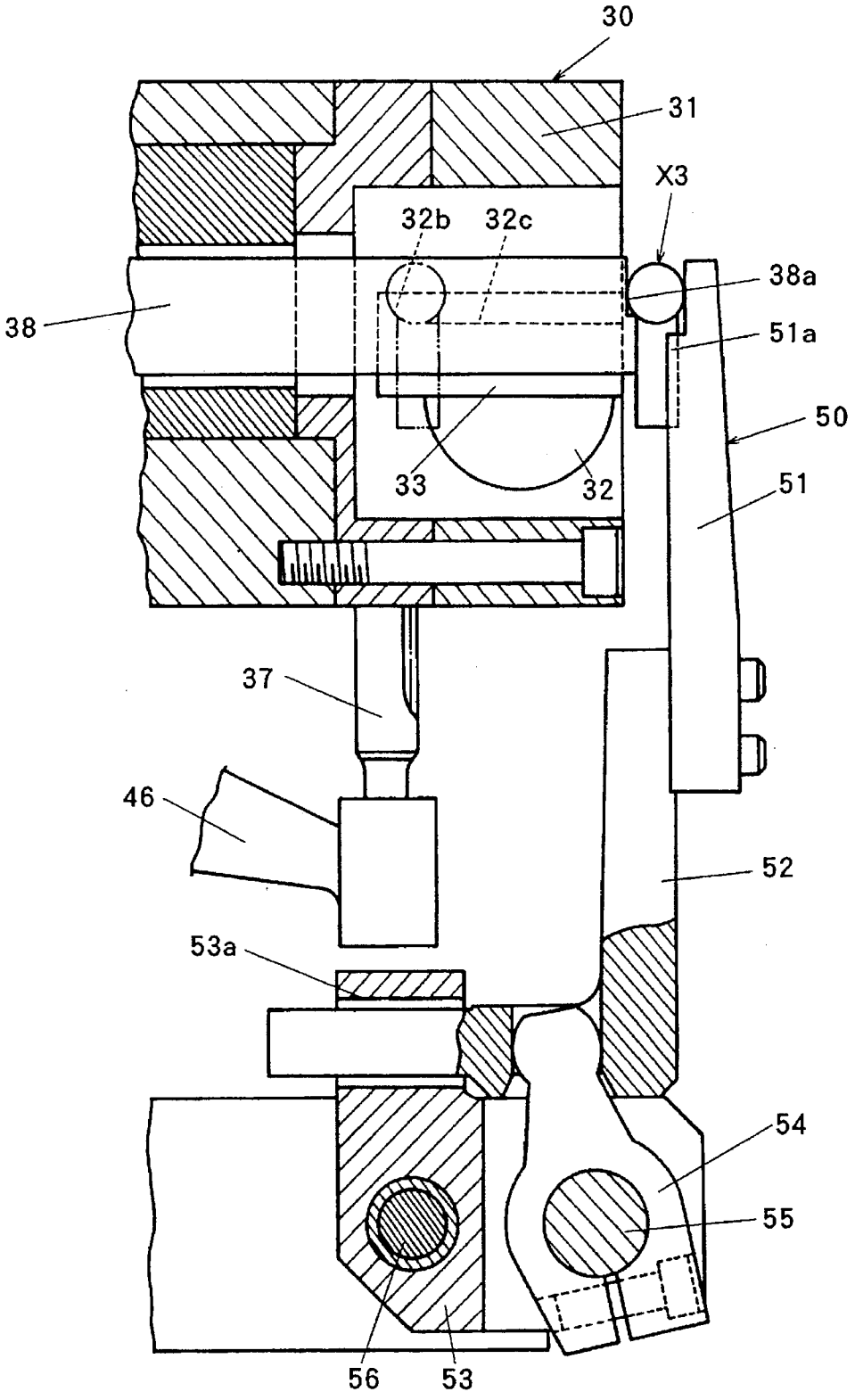
FIG. 8 is a side view of grasping means used for the position change station of FIG. 3.

The position change station S4 is further provided with a knockout pin 38 for pushing the intermediate work X3 in the vertical position out of the rotation unit 30. The knockout pin 38 has a pushing face 38*a* with a step corresponding to the shape of the intermediate work X3 so that the vertically positioned intermediate work X3 can be pushed out without changing its vertical position as is shown in FIG. 8. After changing the position of the intermediate work X3 and the punch 24 moves backward, the knockout pin 38 is inserted into the space between the holding plates 33 so as to push the intermediate work X3 guided along the guide grooves 33*c* out of the rotation unit 30. Thus, the intermediate work X3 is taken out of the fourth station S4 with the ball-like head (d) upward and with the center of the ball-like head (d) corresponding to the center of the punch 24. The vertically positioned intermediate work X3 is caught by the chuck 9*d* to be transported to the subsequent forging station S5.

In the fifth forging station S5, the ball-like head (d) of the intermediate work X3 is forged with the die 15 and the punch 25, so as to form an intermediate work X4 with a flat head. The intermediate work X4 is transported to the final forging station S6, where the flat head is pierced by a piercing punch 26*a* contained in the punch 26. Thus, the work X having the shank (a) and the ring-shaped head (b) as shown in FIG. 21 is produced. A pierced portion (f) is discharged through a discharging passage 16*a* within the die 16.

The dies 11 to 13 and 15 in the forging stations S1 to S3 and S5 are respectively provided with knockout pins 11*a*, 12*a*, 13*a* and 15*a* for pushing the work out of the dies after the punches 21 to 23 and 25 move backward. Similarly, the punches 21, 22 and 25 are provided with knockout pins 21*a*, 22*a* and 25*a*, respectively.

In this manner, the work X consisting of the shank (a) and the ring-shaped head (b) can be consistently produced by the forging apparatus alone because the position of the intermediate work can be changed in the fourth station S4. This leads to mass-production of the work X.

Furthermore, the holding parts 33*b* on the holding plates 33 are positioned so that the center of the ball-like head (d) of the vertically positioned intermediate work X3 pushed out of the rotation unit 30 is at the same height as the centers of the punches of the previous forging stations. Therefore, the centers of the dies and punches in the stations prior to the position change station S4 can be positioned at the same height as the centers of the dies and punches in the stations posterior to the position change station S4. This can prevent the entire structure of the forging apparatus from becoming complicated because the punches and the dies in all the forging stations can be positioned at the same height.

Figure 10:
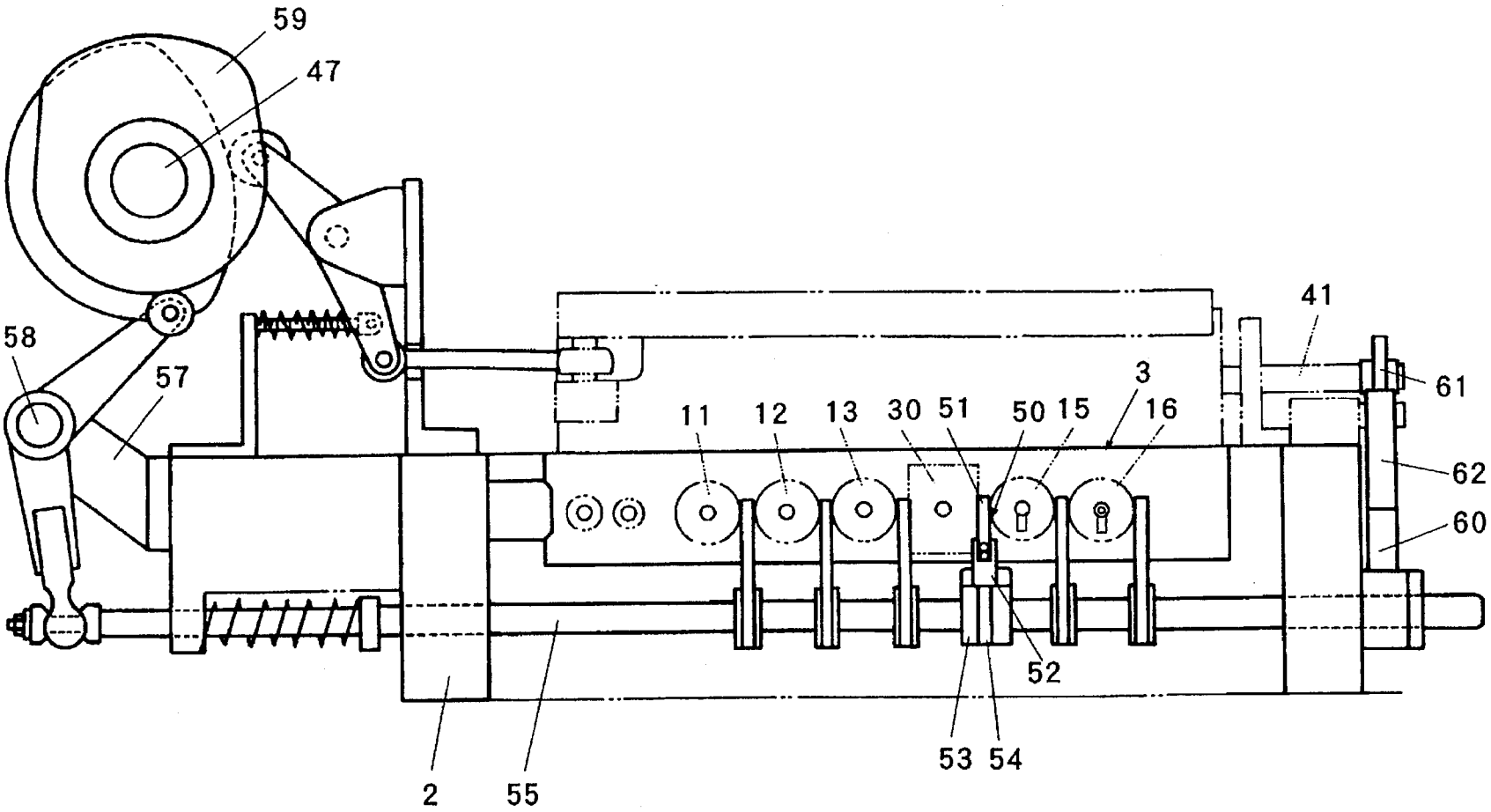
FIG. 10 is an explanatory diagram of a driving system for the grasping means of FIG. 8.

In addition, the position change station S4 is further provided with grasping means 50, as is shown in FIGS. 8 and 10, disposed in front of the rotation bodies 32 for grasping the intermediate work X3 pushed out of the space between the rotation bodies 32 without changing its vertical position.

The grasping means 50 includes, as shown in FIG. 8, a grasping member 51 having a receiving face 51*a* for receiving the ball-like head (d) and the shank (a) of the intermediate work X3, a supporting member 52 for supporting the base of the grasping member 51, a moving member 53, which is substantially U-shaped in a plan view, having a supporting part 53*a* for supporting the supporting member 52 slidingly movably forward and backward, a base axis 55 having a swing arm 54 engaged with a hole 52*a* of the supporting member 52, and a guide rod 56 disposed parallel to the base axis 55 for supporting the back portion of the moving member 53 slidingly movably from side to side. The base axis 55 is, as is shown in FIG. 10, disposed in front of and below the die block 3 so as to be movable from side to side. The base axis 55 is connected, at one end thereof, to the lower end of a bell crank 58 via a supporting bracket 57 supported on the base 2. The upper end of the bell crank 58 is in contact with a base axis driving cam 59 fixed on a predetermined position on the transmission shaft 47. Thus, as the transmission shaft 47 interlocked with the crank shaft 7 is rotated, the bell crank 58 is swung through the rotation of the base axis driving cam 59, thereby reciprocating the base axis 55 at desired intervals. This movement of the base axis 55 is transferred through the swing arm 54 so as to move the moving member 53 and the supporting member 52 from side to side. As a result, the grasping member 51 supported by the supporting member 52 is moved between a position in front of the rotation unit 30 of the position change station S4 and a stand-by position on the side of the rotation unit 30 shown in FIG. 10. On the peripheral face of the other end of the base axis 55 is disposed a spline, in which a base axis rotating lever 60 is inserted. The lever 60 is connected to a swing lever 62 which is swung by a base axis rotating cam 61 disposed at the end of the driving shaft 41. As the base axis rotating cam 61 is rotated by the driving shaft 41, the base axis rotating lever 60 is rotated via the swing lever 62. When the grasping member 51 is positioned in front of the rotation unit 30 as a result of the rotation of the base axis rotating lever 60, the base axis 55 is rotated at a predetermined angle. As a result, the grasping member 51 is swung to and from the front face of the rotation unit 30 at a predetermined timing, so as to grasp the intermediate work X3.

In this manner, the intermediate work X3 pushed out of the rotation unit 30 by the knockout pin 38 is grasped between the receiving face 51*a* of the grasping member 51 in front of the rotation unit 30 and the pushing face 38*a* of the knockout pin 38 without changing its vertical position. While the intermediate work X3 is thus grasped, the chuck 9*d* catches the intermediate work X3 and transports it to the subsequent forging station S6.

In the above description, the ring-shaped head (b) is pierced in the sixth forging station S6, but the forging operation can be completed by merely flattening the ball-like head (d) in the fifth forging station S5. Alternatively, the ball-like head (d) or the shank (a) can be subjected to another type of forging operation.

Furthermore, it is possible to consistently produce another work such as an eye bolt consisting of a ring-shaped head (b) and a shank (a) having a thread groove with one forging apparatus. For this purpose, as is shown in FIG. 12, a second position change station S7 for changing the position of the work X again to the horizontal position and a rolling station S8 including a rotary type thread rolling die 65 for forming the thread groove (g) on the peripheral surface of the shank (a) of the work X, whose position has been changed in the position change station S7, can be further provided as the seventh and eighth stations subsequent to the forging station S6.

Figure 12:
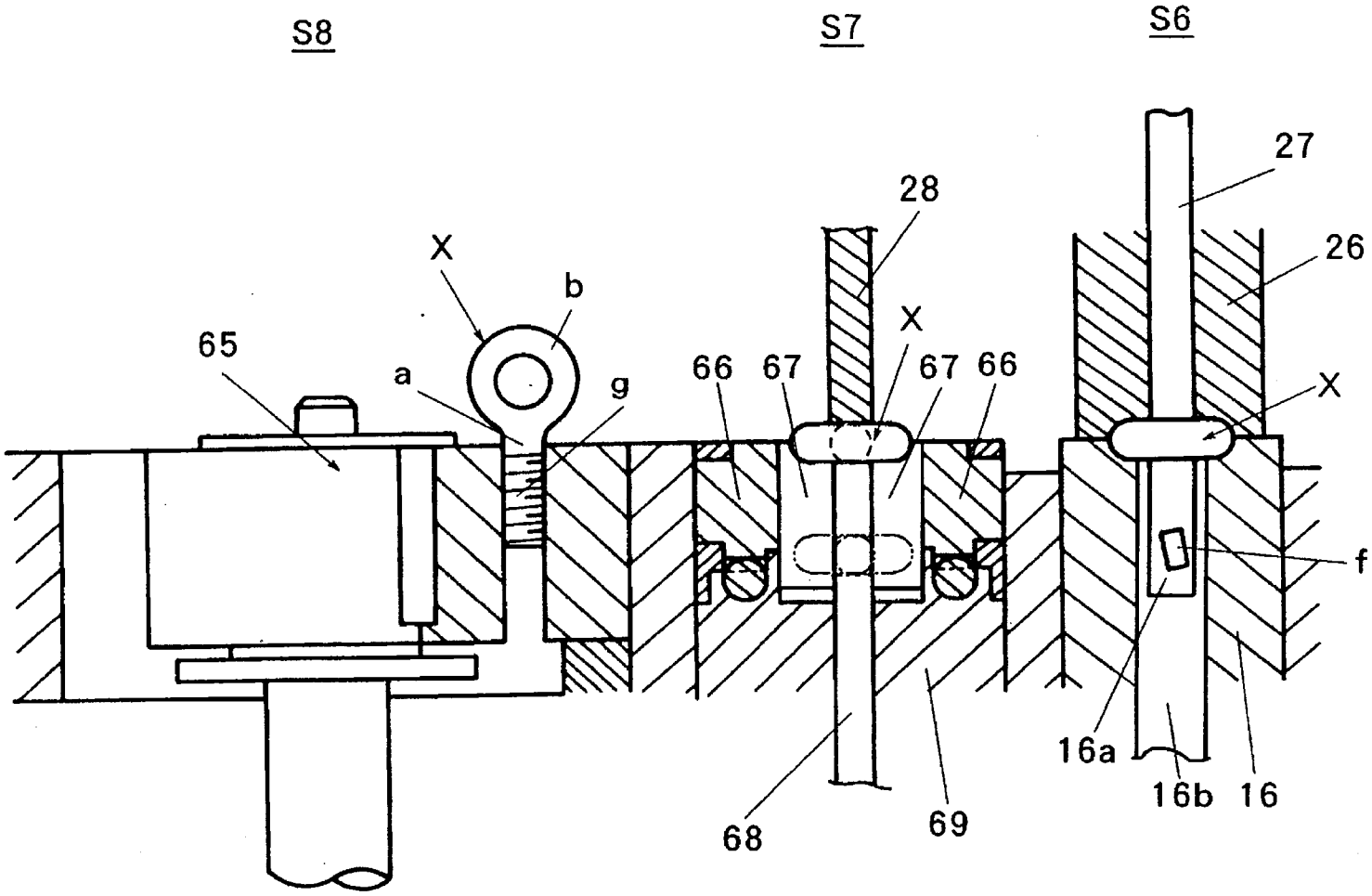
FIG. 12 is a sectional view of a main part of a forging apparatus according to another embodiment capable of thread rolling.

In this case, the sixth forging station S6 is not only provided with the discharging passage 16*a* for discharging the pierced portion (f) within the die 16 but also provided with a knockout pin 16*b* for pushing the work X out of the die 16 as shown in FIG. 12. The second position change station S7 has the same structure as that of the position change station S4 shown in FIGS. 3 to 8, and driving means (not shown) similar to the driving means 40 is used to change the position of the work X, whereas the rotation direction of rotation bodies 66 and the rotation timing is set differently from those in the position change station S4. The specific structure of the second position change station S7 is herein omitted.

Figure 13:
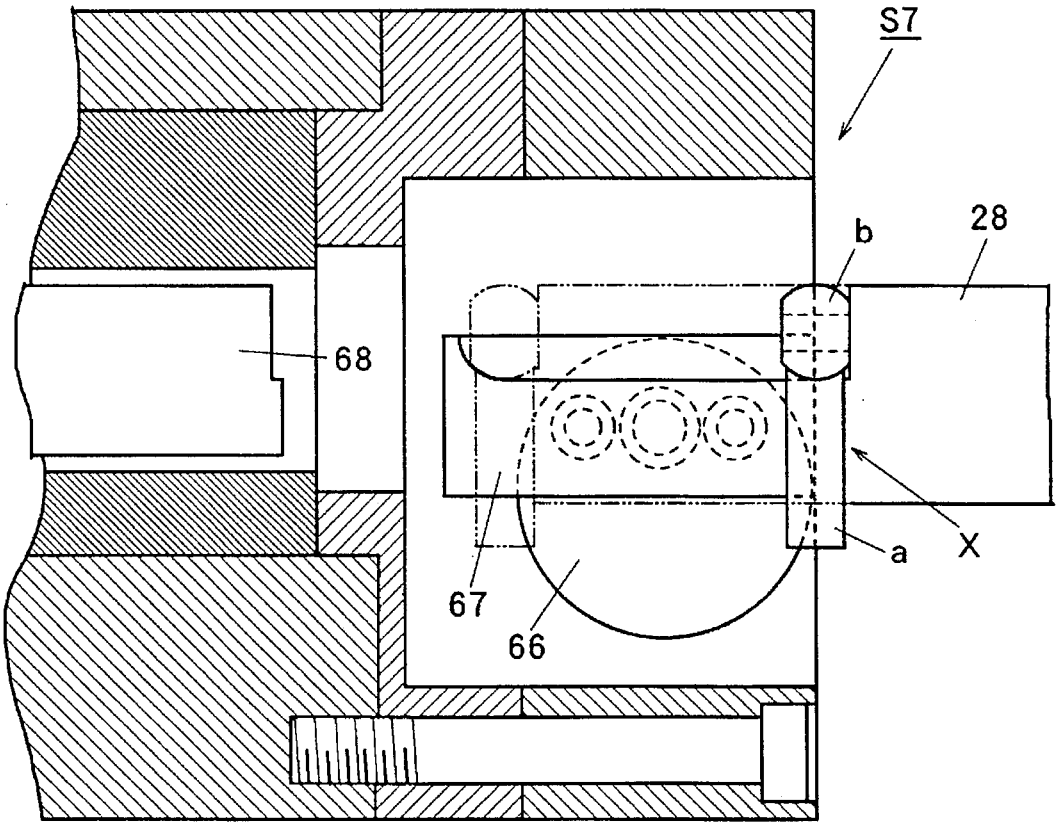
FIG. 13 is an explanatory diagram of an operation for driving a work into a space between rotation bodies in a second position change station.
Figure 14:
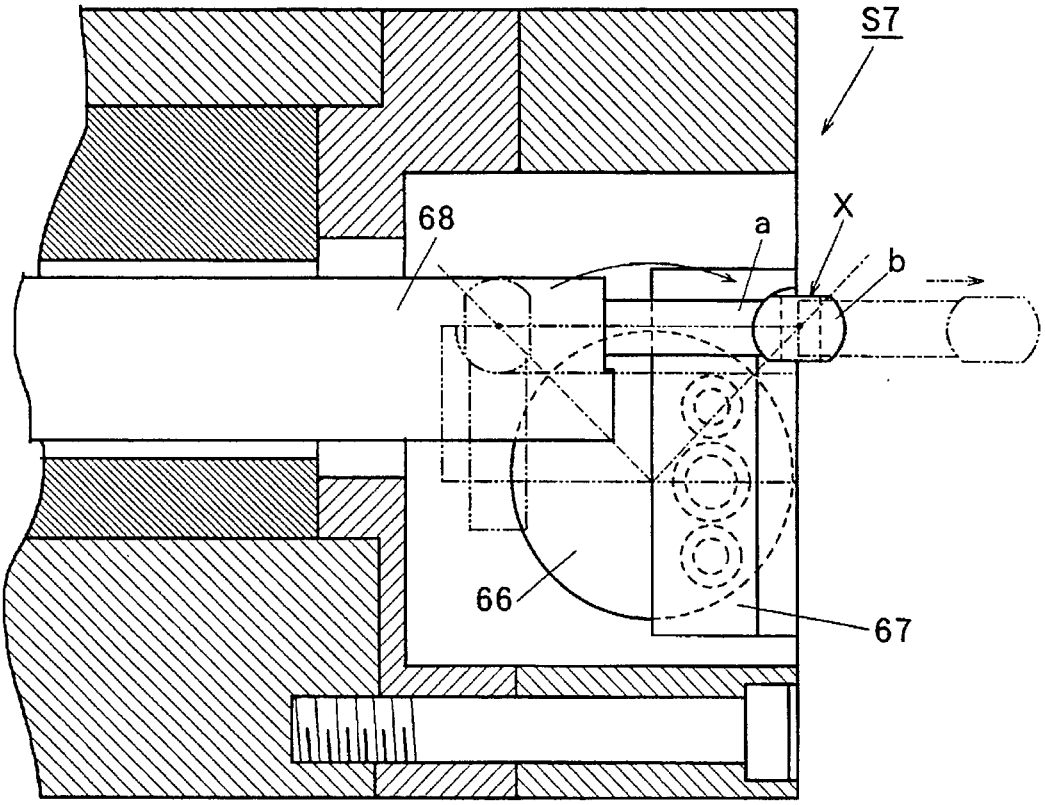
FIG. 14 is an explanatory diagram of rotation movement of a work in the second position change station.

The work X completed with the ring-shaped head (b) in the sixth forging station S6 is pushed out of the die 16 by the knockout pin 16*b* while keeping its vertical position, and is caught by a chuck (not shown) to be transported to the subsequent second position change station S7. The work X is thrusted by a punch 28 disposed on the ram 4 into a space between holding plates 67 of the second position change station S7 while keeping its position as shown in FIG. 13. In this case, the punch 28 has a pushing face with a step corresponding to the shape of the work X and has a width substantially the same size as the space between the holding plates 67. The work X is thrusted into a space between the rotation bodies 66 by the punch 28 with the ring-shaped head (b) upward and the shank (a) extending perpendicularly to the driving direction of the punch 28, i.e., while keeping its vertical position. When the work X is thrusted by the punch 28 into the space between the holding plates 67, the work X is held at the bottom of the space between the holding plates 67 without changing its position as is shown with a two-dot chain line in FIG. 13. Then, the driving means (not shown) similar to the driving means 40 rotates the rotation bodies 66 and the holding plates 67 by 90 degrees as shown with a solid line in FIG. 14, thereby changing the position of the work X so as to have the shank (a) extending parallel to the driving direction of the punch 28 and the ring-shaped head (b) forward, i.e., the horizontal position. Then, the work X is pushed out of a rotation unit 68 by a knockout pin 68 while keeping its horizontal position.

The horizontally positioned work X is caught by a chuck (not shown) to be transported to the subsequent rolling station S8. The work X is driven by a punch 29 disposed on the ram 4 into a space between grasping members 65*a* of the rolling station S8 without changing its horizontal position, and the groove (g) is formed on the peripheral surface of the shank (a) by the thread rolling die 65. In this manner, the eye bolt consisting of the ring-shaped head (b) and the shank (a) having the groove (g) is produced with one forging apparatus. This leads to mass-production of the work X in the shape of an eye bolt.

Although the rotation bodies 32 or 66 are provided with the holding plates 33 or 67 so as to hold the intermediate work X3 or the work X therebetween in this embodiment, it is possible to hold the intermediate work X3 or the work X directly between the rotation bodies 32 or 66 without providing the holding plates 33 or 67.

Figure 15:
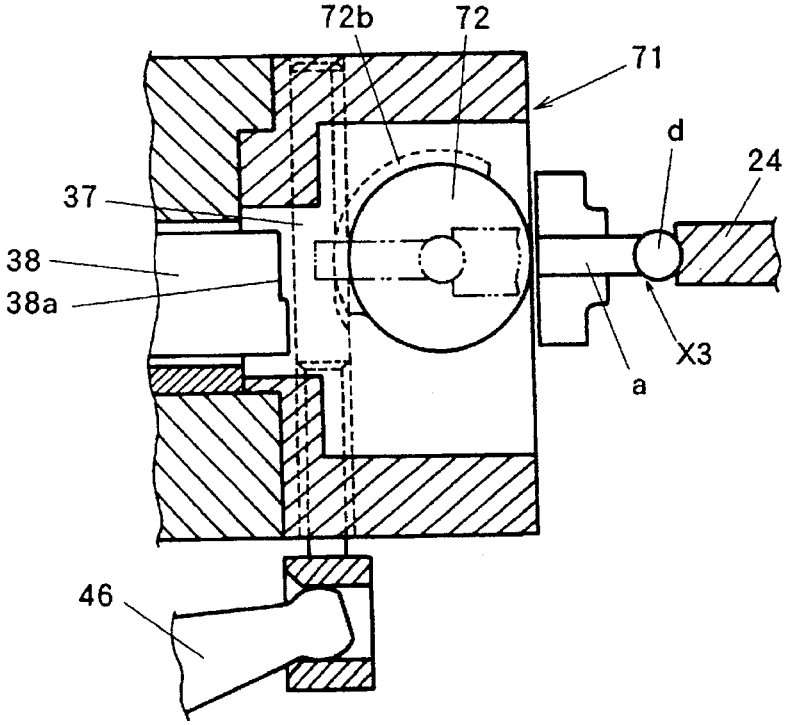
FIG. 15 is a longitudinal sectional side view of another type of rotation bodies.
Figure 16:
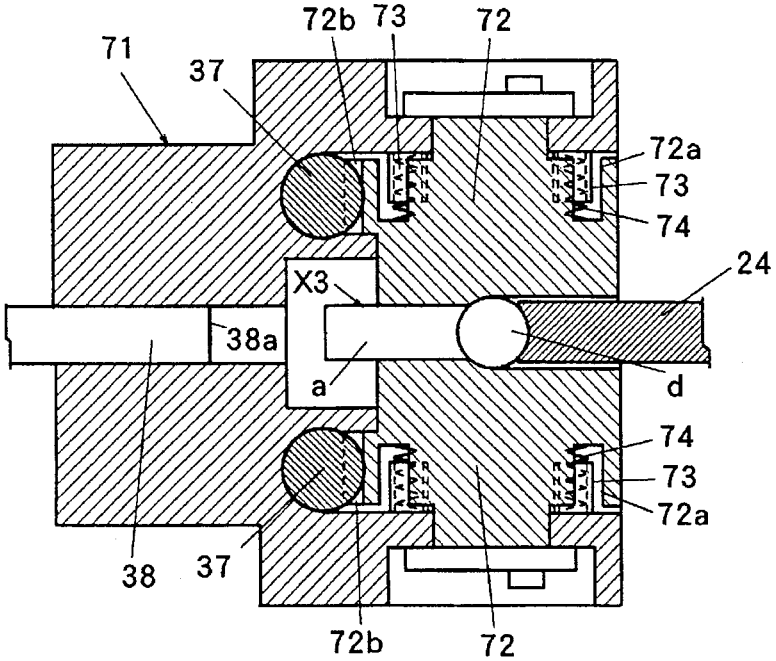
FIG. 16 is a horizontal sectional view of the rotation bodies of FIG. 15.
Figure 17:
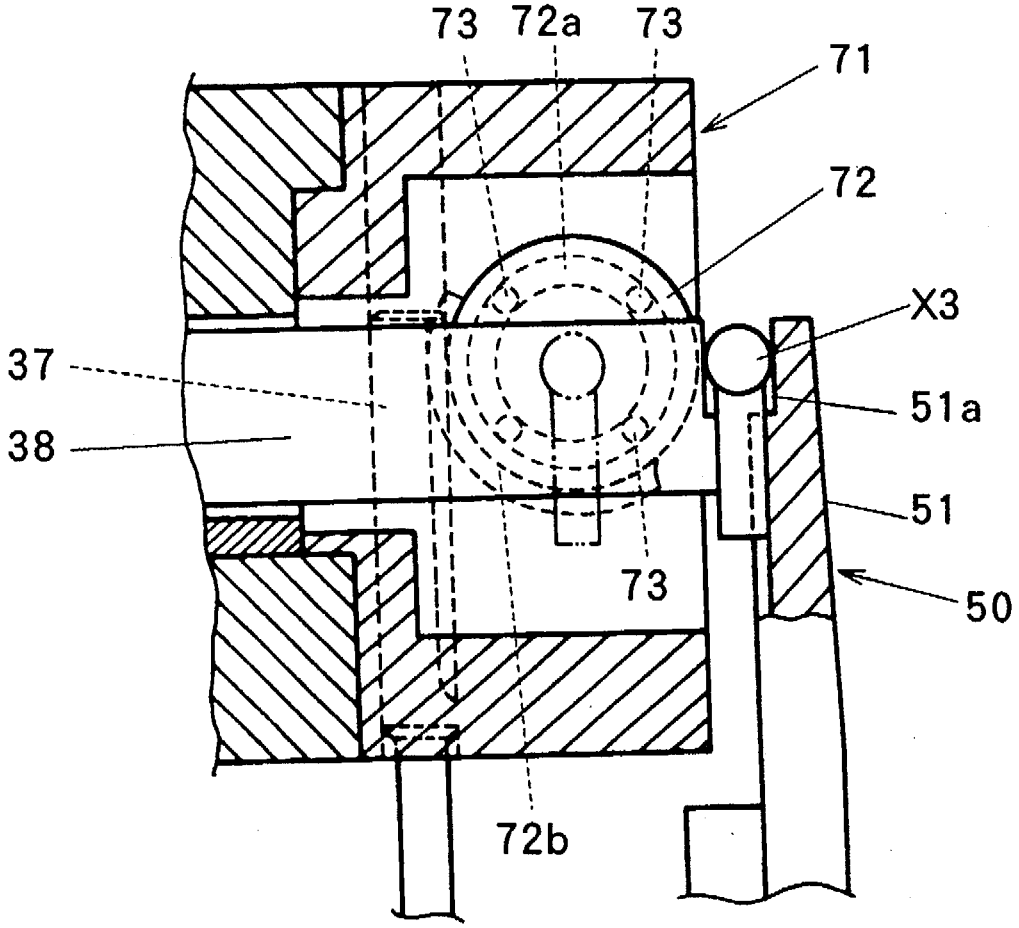
FIG. 17 is an explanatory diagram of an operation for pushing an intermediate work out of the space between the rotation bodies of FIG. 15.

In this case, a unit case 71 as is shown in FIGS. 15 to 17 can be used. The unit case 71 comprises a pair of rotation bodies 72, which are rotatable around a horizontal axis perpendicular to the driving direction of the punch and are movable along the axis by a predetermined distance. The rotation bodies 72 have peripheral grooves 72*a* on their faces not opposing each other. A plurality of guide sleeves 73 projecting from the unit case 71 are engaged with the grooves 72*a* so that the rotation of the rotation bodies 72 can be guided. Between each guide sleeve 73 and each groove 72*a* is disposed a spring 74 one end of which is inserted into the corresponding guide sleeve. The springs 74 apply a force to the rotation bodies 72 so as to bring them close to each other. When the intermediate work X3 is thrusted into a space between the rotation bodies 72 by the punch 24, the intermediate work X3 is held between the rotation bodies 72 owing to the force applied by the springs 74.

As driving means for the rotation bodies 72, similarly to the driving means 40, on the peripheral surfaces of the rotation bodies 72 are disposed gears 72*b* which are engaged with the racks 37. Through the vertical movement of the racks 37, the rotation bodies 72 can be rotated by 90 degrees.

In this embodiment, the ball-like head (d) of the intermediate work X3 is always at the same height against the rotation center of the rotation body 32 or 72 regardless of the position of the intermediate work X3, so that the centers of the punches and the dies in all the stations can be positioned at the same height. It goes, however, without saying that there is no need to always set the ball-like head (d) of the intermediate work X3 at the same height. In addition, when the grasping means 50 is used, the grasping member 51 of the grasping means 50 can be used also as a punch for driving the intermediate work X3 into the space between the holding plates 33 or the rotation bodies 32. In adopting this structure, there is no need to separately provide a punch in the position change station S4.

Figure 18:
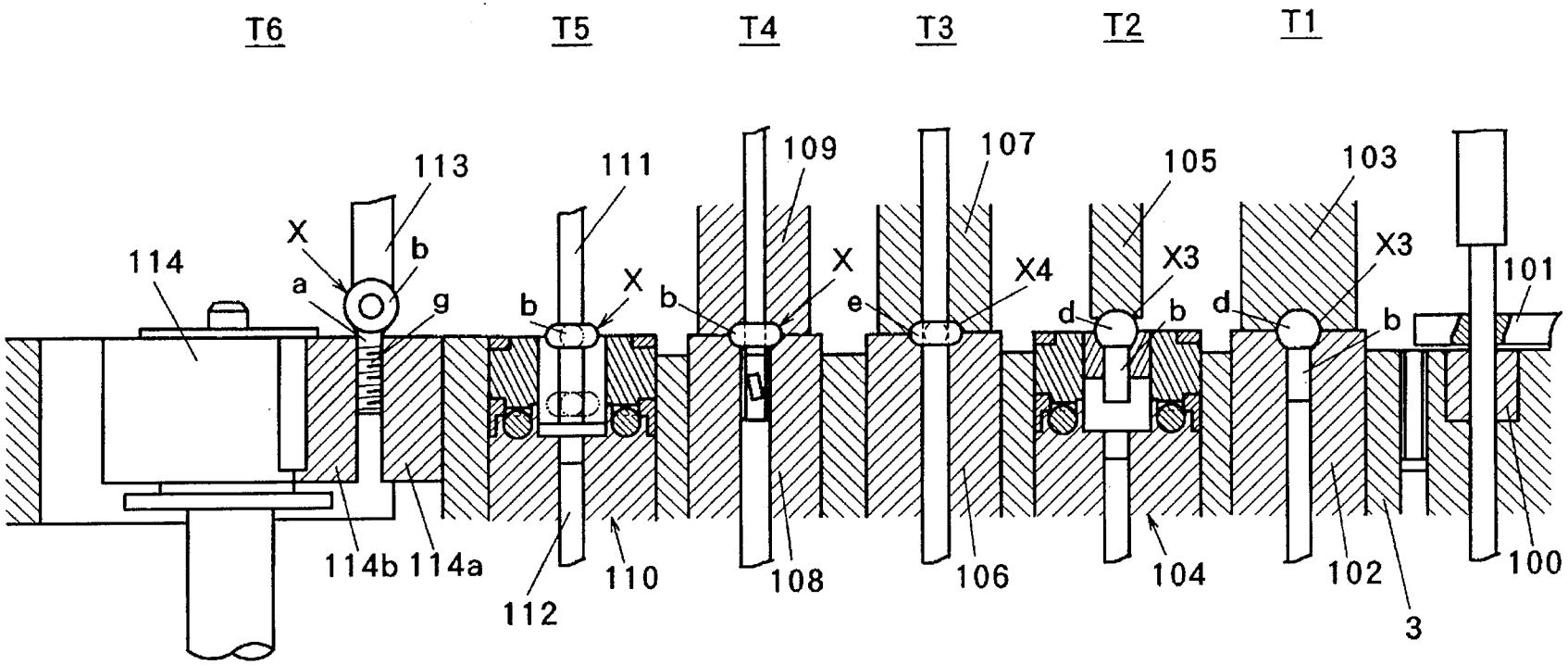
FIG. 18 is a schematic sectional view of a forging apparatus for producing an eye bolt according to still another embodiment.
Figure 19:
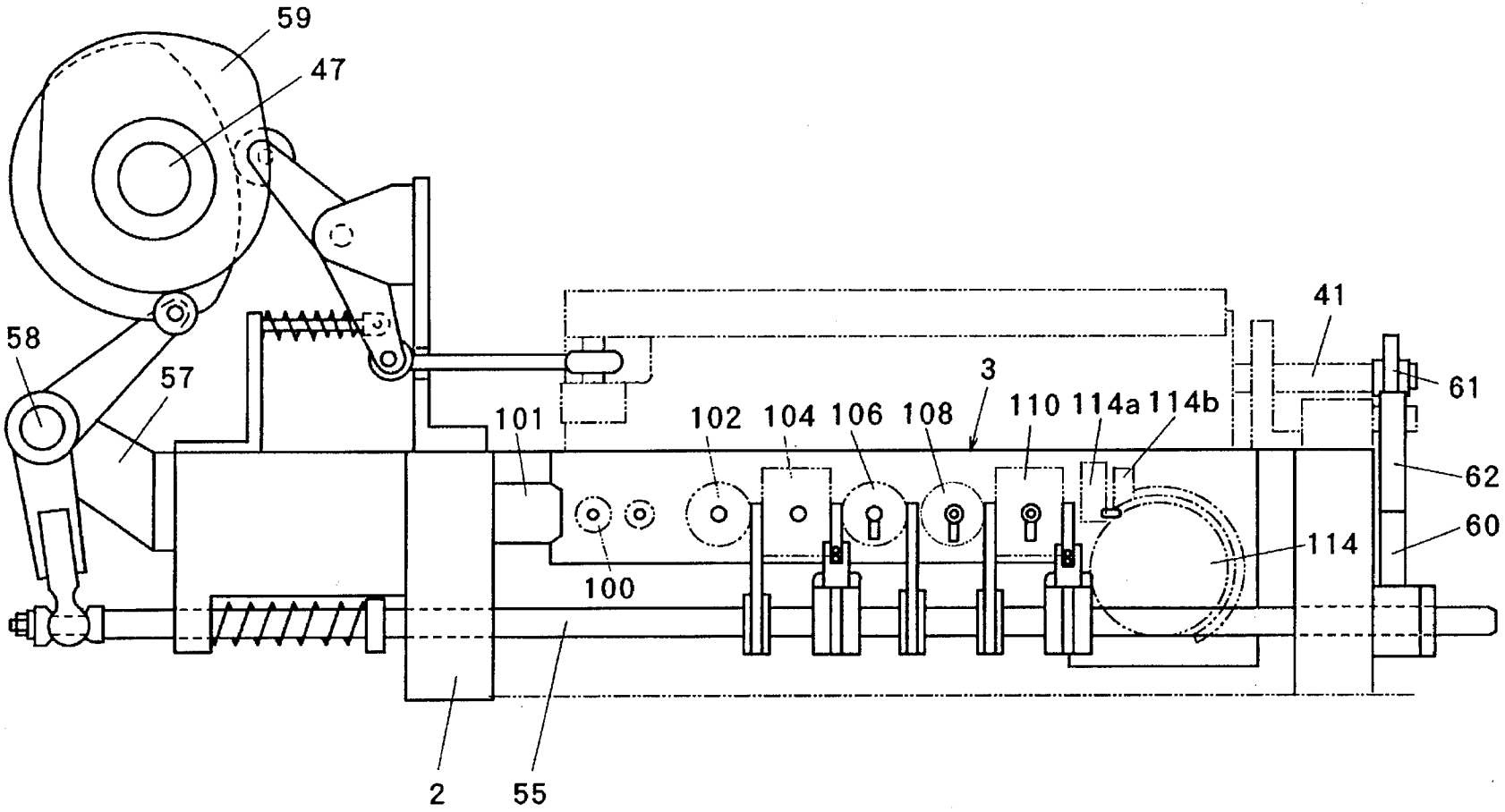
FIG. 19 is a schematic front view of the forging apparatus of FIG. 18.
Figure 20:
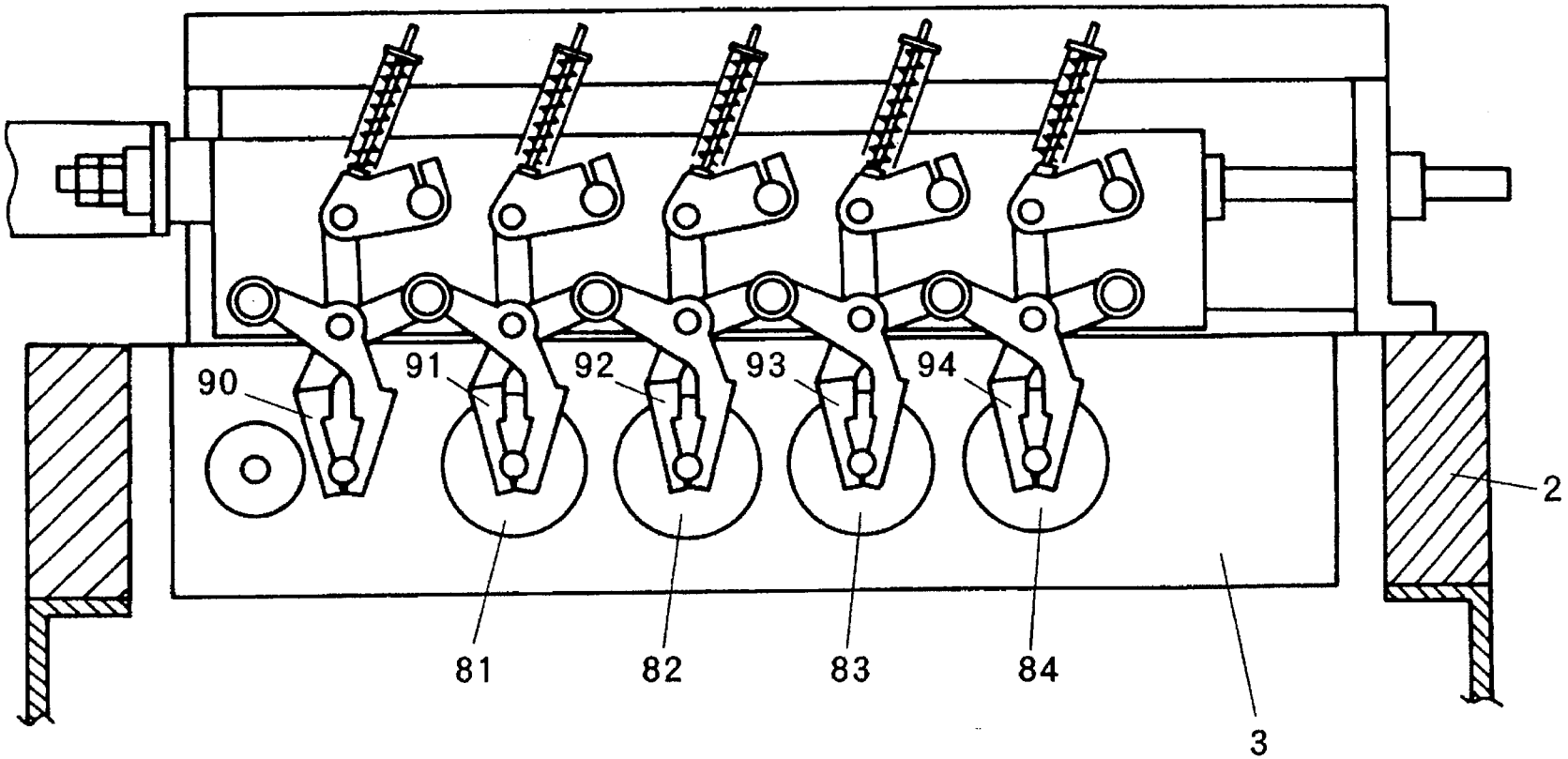
FIG. 20 is a schematic front view of a main part of a typical forging apparatus.

Alternatively, FIGS. 18 and 19 show another type of forging apparatus for producing an eye bolt such as the work X consisting of the ring-shaped head (b) and the shank (a) having the groove (g). The first and second forging stations S1 and S2 described above are omitted in this forging apparatus, so that the forging procedure can be simplified and the entire structure of the forging apparatus can be minimized.

A first forging station T1 of the forging apparatus of FIG. 18 is provided with a die 102 and a punch 103 for driving a rod-like work, which has been fed from the tip opening of a material supply quill 100 by a predetermined length and has been cut into a desired length, so as to form an intermediate work X3 having a shank (a) and a ball-like head (d) in one stage of the procedure.

A second forging station T2 serves as a first position change station for changing the position of the intermediate work X3 having been thrusted into a rotation unit 104 by a punch 105 to the vertical position with the ball-like head (d) upward and the shank (a) extending perpendicularly to the driving direction of the punch 105. The first position change station T2 has the same structure and the same function as the position change station S7 shown in FIGS. 12 to 14. Therefore, the intermediate work X3 is pushed out of the rotation unit 104 so as to have the ball-like head (d) upward and the center of the ball-like head (d) positioned at the same height as the center of the punch 105. The vertically positioned intermediate work X3 is then caught by a chuck (not shown) and transported to a subsequent forging station T3.

The third forging station T3 has the same structure and the same function as the fifth forging station S5 described above. Therefore, the ball-like head (d) of the intermediate work X3 is flattened with a die 106 and a punch 107, so as to form an intermediate work X4 having a flat head, which is transported to a fourth forging station T4 while keeping its vertical position.

The fourth forging station T4 has the same structure and the same function as the sixth forging station S6. Therefore, the flat head of the intermediate work X4 is pierced with a piercing punch 109*a* contained in a punch 109, so as to form the work X constituting of the shank (a) and the ring-shaped head (b) as shown in FIG. 21. The work X is then transported to a subsequent second position change station T5 while keeping its vertical position.

The second position change station T5 has the same structure and the same function as the second position change station S7 described above. Therefore, the work X is thrusted into the space between the rotation bodies 66 by a punch 111 while keeping its vertical position, shifted to the horizontal position through the rotation of the rotation bodies 66, and pushed out of a rotation unit 110 by a knockout pin 112 while keeping its horizontal position. The work X is then transported to a subsequent rolling station T6.

The work X is driven into the space between grasping members 114*a* and 114*b* of the rolling station T6 by a punch 113 while keeping its horizontal position, and the groove (g) is formed on the peripheral surface of the shank (a) with a rotary type rolling die 114. An eye bolt consisting of a ring-shaped head (b) and a shank (a) having a groove (g) is thus produced.

According to this configuration, a work X such as an eye bolt consisting of a ring-shaped head (b) and a shank (a) having a groove (g) can be produced with one forging apparatus alone. This not only enables mass-production of the work X but also simplifies the forging procedure and minimizes the entire structure of the forging apparatus.

In these embodiments, the rotation units included in the position change stations S4, S7, T2 and T5 are of a separate die block system, and can be separately assembled on the die block 3. Therefore, it is possible to remove any of the rotation units, if necessary, so as to replace it with another separate type die block including a normal die. Thus, the stations can work as a position change station or a forging station as occasion demands.

As described so far, in the present forging apparatus, an intermediate work can be shifted from the horizontal position to the vertical position during the forging procedure. Therefore, a work consisting of a shank and a ring-shaped head can be consistently produced with one forging apparatus alone, resulting in mass-production and a low production cost of such a component part.

Furthermore, while the forging apparatus comprises a position change station, the punches and the dies of all the stations can be located at the same height, which prevents the structure of the forging apparatus from becoming complicated.

In addition, since the present forging apparatus can comprise two position change stations, a thread groove can be consistently formed on the peripheral surface of a shank of a work consisting of the shank and a ring-shaped head with one forging apparatus. This results in mass-production of a component part such as an eye bolt consisting of a shank with a thread groove and a ring-shaped head.

As this invention may be embodied in several forms without departing from the spirit of essential characteristics thereof, the present embodiment is therefore illustrative and not restrictive, since the scope of the invention is defined by the appended claims rather than by the description preceding them, and all the changes that fall within metes and bounds of the claims, or equivalence of such metes and bounds thereof are therefore intended to be embraced by the claims.

What is claimed is:

1. A multi-stage forging apparatus for forging a work in stepwise transportation by a transport through plural forging stations each provided with a die in a bank of die and a punch in a bank of punches moved relative to each other by a driver in a forging direction, the forging apparatus comprising a)a first forging station to form an intermediate work having a shank parallel to said forging direction at said first forging station and a head at one end of the shank, b)a second station to forge the head of the intermediate work in a direction perpendicular to a direction in which the shank extends at said second forging station, and c) a position change station between said first and second forging stations, the position change station including:

thrusting means in said punch bank for thrusting the intermediate work in said forging direction;

a pair of rotation bodies in said die bank for sandwiching and holding the intermediate work having been thrust by the thrusting means;

driving means for rotating the rotation bodies by 90 degrees after the intermediate work is held by the rotation bodies, so that the intermediate work is shifted to a rotated position where the shank extends perpendicularly to the forging direction; and pushing means for pushing the intermediate work out of a space between the rotation bodies for transport in said rotated position.

2. The multi-state forging apparatus according to claim 1, wherein the position change station further includes grasping means having a receiving face for receiving the intermediate work having been pushed out of the space between the rotation bodies for grasping the intermediate work between the receiving face thereof and a pushing face of the pushing means without changing the position of the intermediate work, the grasping means being able to reciprocate between a position in a space between said pushing face and said thrusting means and a stand-by position exterior said space.

3. The multi-state forging apparatus according to claim 1, wherein the head of the intermediate work held between the rotation bodies is located at the same height compared to a rotation center of the rotation bodies as the head of the intermediate work whose position has been changed by rotating the rotation bodies by 90 degrees.

4. The multi-state forging apparatus according to claim 1, wherein the thrusting means and the pushing means are coaxial and the driving means rotates the bodies by 90 degrees with the head on said coaxis to said rotated position with the head on said coaxis.

5. The multi-state forging apparatus according to claim 1, wherein the thrusting means is driven by said driver.

6. The multi-state forging apparatus according to claim 1, wherein the driver and said driving means are commonly driven.

7. The multi-state forging apparatus according to claim 1, wherein said driving means rotates the rotation bodies and the intermediate work by 90 degrees about an axis parallel to the direction of said transportation.

8. A multi-stage forging apparatus for forging a work in stepwise transportation through plural forging stations each provided with a die and a punch, so that an intermediate work having a shank and a head at one end of the shank is formed and that the head of the intermediate work is forged in a direction perpendicular to a direction in which the shank extends, the forging apparatus comprising:

a first forging station to form an intermediate work having a shank parallel to a forging direction at said first forging station and a head at one end of the shank, a first position change station, among the plural forging stations subsequent to the first forging station, for shifting the intermediate work formed in the previous forging stations from a first position having the shank parallel to said forging direction to a second position having the shank perpendicular to said forging direction and pushing the secondly positioned intermediate work out of the die of the first position change station;

a final forging station disposed subsequently to the first position change station for forging the head of the intermediate work in the forging direction perpendicular to the direction in which the shank extends so as to obtain a final work;

a second position change station disposed subsequently to the final forging station for shifting the final work from the second position to the first position and pushing the firstly positioned final work out of the die of the second position change station; and a rolling station disposed subsequently to the second position change station and including a thread rolling die for forming a thread groove on a peripheral surface of the shank of the firstly positioned final work.

9. The multi-stage forging apparatus according to claim 8, wherein the first position change station includes:

thrusting means for thrusting the intermediate work in the first position parallel to a driving direction of the punch toward the die of the first position change station;

a pair of rotation bodies adjacent the die of the first position change station for sandwiching and holding the intermediate work having been thrust by the thrusting means;

driving means for rotating the rotation bodies by 90 degrees, so that the intermediate work is shifted to the second position where the shank extends in a direction perpendicular to the driving direction of the punch; and pushing means for pushing the intermediate work out of a space between the rotation bodies so that the intermediate work is secondly positioned adjacent the die, and the second position change station includes:

thrusting means for thrusting the final work formed in the final forging station while keeping its second position;

a pair of rotation bodies adjacent the die of the second position change station for sandwiching and holding the final work having been thrust by the thrusting means;

driving means for rotating the rotation bodies by 90 degrees, so that the final work is shifted to the first position where the shank extends parallel to the driving direction of the punch; and pushing means for pushing the final work out of a space between the rotation bodies so that the final work is firstly positioned adjacent the die.

* * * * *